United States Patent [19]

Main et al.

[11] 4,433,935

[45] Feb. 28, 1984

[54] SIGN BRACKET

[75] Inventors: Keith A. Main, Howell; David U. Hillstrom, Novi, both of Mich.

[73] Assignee: Marketing Displays, Inc., Farmington Hills, Mich.

[21] Appl. No.: 274,400

[22] Filed: Jun. 17, 1981

[51] Int. Cl.[3] ..... B25G 3/36

[52] U.S. Cl. ..... 403/385; 248/125; 403/49

[58] Field of Search ..... 248/218.4, 121, 124, 248/125, 122, 469, 473; 40/612, 606, 607; 403/188, 192; 404/6, 9; 403/385, 49

[56] References Cited

U.S. PATENT DOCUMENTS

| | | | |
|---|---|---|---|
| 2,523,785 | 9/1950 | Sereno | 403/397 X |
| 2,586,724 | 2/1952 | Sannebeck | 248/408 X |
| 2,961,787 | 11/1960 | Kies | 248/218.4 X |
| 3,157,001 | 11/1964 | Vail | 403/397 X |
| 4,259,803 | 4/1981 | Sittler | 40/607 |
| 4,288,053 | 9/1981 | Sarkisian | 40/607 X |

*Primary Examiner*—J. Franklin Foss

*Attorney, Agent, or Firm*—Harness, Dickey & Pierce

[57] ABSTRACT

A sign bracket for attaching a sign to a stand particularly useful for supporting two cross members to which a flexible sign is attached. The bracket includes a sleeve which slidably overfits a vertical stand member and includes a resilient latch which permits the sleeve to be located at various vertical positions on the stand. The sleeve is affixed to a pair of sign holding mechanisms forming a channel having an open end which receives a sign cross member and having a resilient latch member located at the channel open end which restrains the cross member within the channel.

3 Claims, 7 Drawing Figures.

SIGN BRACKET

BACKGROUND—SUMMARY OF THE INVENTION

The present invention relates to adjustable mounting brackets for signs and poster display devices of all kinds. The invention more particularly relates to brackets for securely holding roll-up and flexible signs in place on construction-type sign standards.

There are numerous sign stands and poster display devices known today which are used for displaying various signs and messages for advertisement and information to the public. On construction sites, the signs are typically positioned on sign standards which are either anchored in the ground, held in place by sandbags or other heavy objects, or are spring mounted on bases which allow them to bend (without tipping over) under high wind forces. Spring mounted sign stands which can be used for this purpose are shown in U.S. Pat. Nos. 3,646,696 and 3,662,482.

The signs commonly used at construction sites are square or diamond in shape, flat, made of metal or wood, and have pertinent informative or warning messages or symbols on them. These signs are bulky and heavy and as a result many problems are encountered in the storage, transportation and mounting of them. To overcome these problems, many construction sites have begun using diamond-shaped signs which are made out of a flexible material, such as cloth or plastic. These signs are lighter than the metal or wood signs and thus are easier to handle, and also are usually adapted to be rolled-up or folded-up for ease of transportation and storage.

The roll-up signs usually have one or more rigid cross-braces to hold them in their fully extended conditions and the sign stands have brackets or other mounting means thereon for holding the signs in place. The brackets presently in use for mounting such signs are often difficult and time consuming to operate, however, and also are difficult to accurately position on the standard.

It is an object of the present invention to provide an improved mounting bracket for holding and securing signs on a pole or pole-type sign stand. It is a further object to provide an improved mounting bracket which overcomes the problems heretofore known with existing adjustable signs and brackets. It is still a further object to provide a sign mounting bracket which has particular ability to quickly and easily mount and secure a roll-up or other flexible-type sign stand on a pole.

In accordance with the invention, an adjustable sign mounting bracket is disclosed which has a sign mounting mechanism on one side and a pole securing mechanism on the other side. The sign mounting mechanism comprises a pair of channel members adapted to hold a cross-brace from a roll-up type sign. A pair of resilient clip members cover the ends of the channels, hold the cross-brace in place, and prevent the cross-brace from being accidentally removed from the channels. The pole securing mechanism comprises a spring actuated member with a projection thereon which is adapted to mate with a corresponding recess in the pole. By activation of the spring actuated member, the entire bracket can be slid along the pole and adjusted to the desired location.

Other objects, features and advantages of the present invention will become apparent from a review of the following description and claims when taken in connection with the accompanying drawings.

DESCRIPTION OF THE PREFERRED EMBODIMENT OF THE INVENTION

Figure 1:
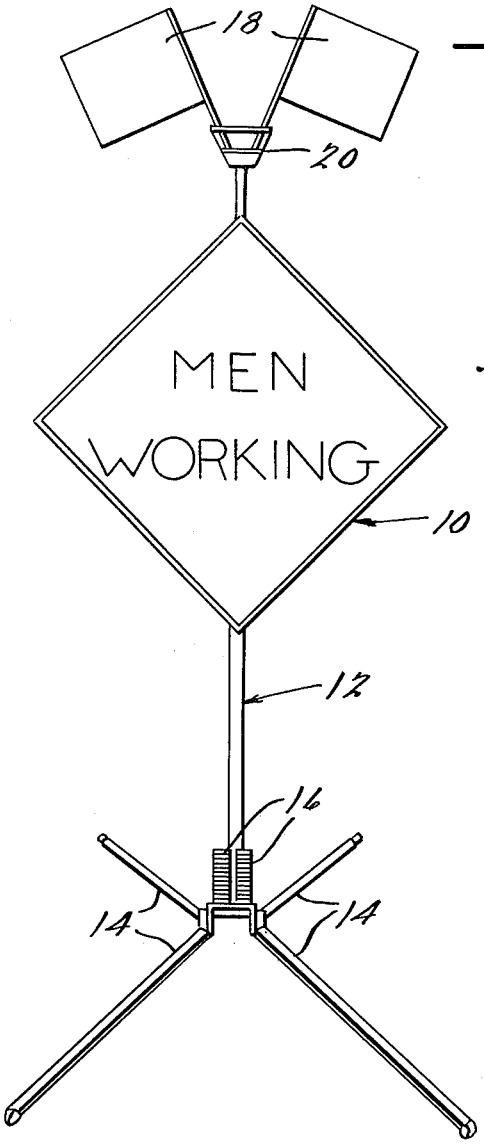
FIG. 1 illustrates a construction-type sign stand with a warning sign mounted thereon.
Figure 2:
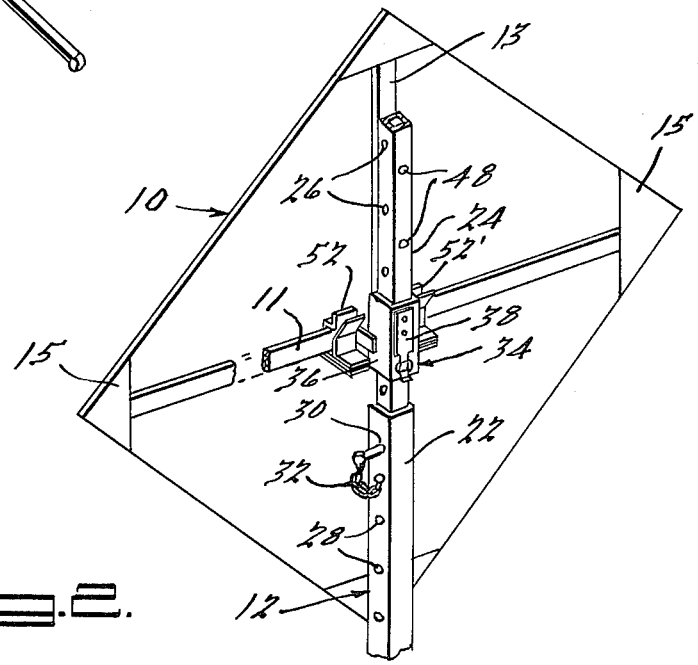
FIG. 2 is a partial rear view in perspective of the construction sign shown in FIG. 1 depicting the adjustable mounting bracket.
Figure 4:
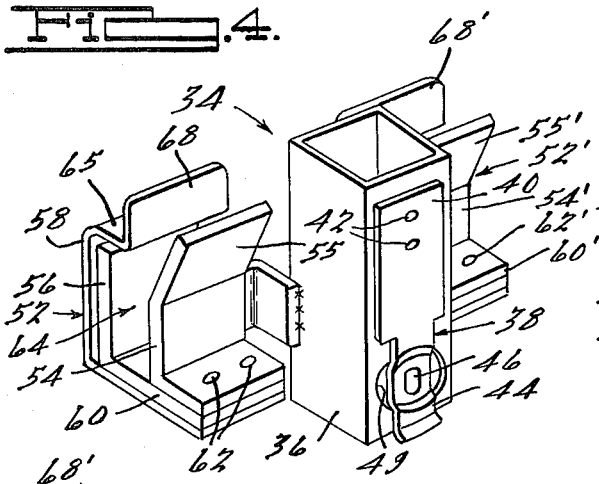
FIG. 4 illustrates the inventive sign mounting bracket (in perspective)

FIGS. 1 and 2 show the inventive mounting bracket in use on a construction sign. The construction sign 10 is mounted on an upright sign stand or pole 12. The pole is supported on the ground by a plurality of legs 14 and a pair of coil springs 16 which allow the sign 10 and pole 12 to deflect downwardly when subjected to wind forces and then return to its normal upright position as shown in FIG. 1. Spring mounted sign stands which can be used for this purpose are disclosed and claimed in U.S. Pat. Nos. 3,646,696 and 3,662,082. It is understood, of course, that the present mounting bracket can be used with any type of sign stand or pole, whether permanently anchored or portable, and whether spring mounted or rigidly mounted.

At the top of the pole 12 are a plurality of warning flags 18 held in place by a bracket 20. As is commonly known in the construction industry, the flags 18 are used as a high-level warning for approaching traffic.

As better shown in FIG. 2, the pole 12 is telescopic and consists in this instance of two sections, a larger lower section 22 and a smaller upper section 24. The section 24 is adapted to slide inside of section 22 and has a plurality of holes 26 which mate with corresponding holes 28 in the lower section 22 so that the sections can be raised or lowered relative to one another and held in place at the desired position by a pin 30 which is positioned through mating pairs of holes 26 and 28. The pin 30 is attached to portion 22 of the pole 12 by a chain 32 or other similar means so that the pin 30 will not get lost or misplaced when it is not positioned in the holes.

The pole 12 can be of any conventional material which is sturdy enough to be used for the described purpose, although preferably it is of a hollow metal construction, such as aluminum or steel. At present, hollow tubes made from extruded aluminum material have provided very satisfactory results. The cross-sectional shape of the pole 12 also is preferably square (as shown in FIG. 2), although it is understood that the pole can have any cross-sectional size and shape so long as it can be used as a stand for a construction sign or similar display.

The sign 10 has a large flexible surface with the warning message or symbol on one side and a pair of cross-braces 11 and 13 on the other side. The cross-braces are made of a rigid material (such as metal or wood) and brace and hold up the flexible sign in its fully extended position. Pockets or attaching means 15 of some kind (as known in the art) hold the ends of the cross-braces at the corners of the sign. As shown in FIG. 2, one of the cross-braces 11 is horizontally disposed when the sign is mounted on the pole while the other cross-brace 13 is vertically situated.

The sign 10 is held in place on the sign stand or pole 12 by an adjustable mounting bracket 34. As better shown in FIGS. 4–7, the bracket has a sign mounting member or sleeve 36 which is hollow and adapted to slidingly fit over one section 24 of the pole 12. The cross-sectional size and shape of the sleeve member 36 preferably should correspond to the cross-sectional size and shape of the pole 12.

The sleeve member 36 has a spring actuated locking member 38 on its rear face. The spring locking member 38 is a flat thin piece of sheet metal and is attached securely at one end 40 to the sleeve 36 by pop rivets 42 or other strong securing means. The other end 44 of the spring locking member 38 has a nub or projection 46 which is directed inwardly toward the center of the sleeve 36 and is sized to mate with a corresponding hole or detent 48 on the pole 12. In order to allow the projection 46 to extend inwardly into the hollow center area of the sleeve member 36, an opening 49 is provided in the rear surface of the sleeve member.

Also, in order to allow the sign 10 to be positioned at various vertical positions on the sign stand or pole 12, a plurality of vertically spaced holes or detents 48 are provided in line along the pole. It is understood of course that the number of holes 48 and the locations and spacing thereof will depend upon the desired use of the sign stand.

The spring locking member 38 also has an angled flange 50 on the end 44 which extends outwardly from the rear surface of the sleeve member 36 and also preferably extends vertically beyond the lower end of the sleeve member 36. This flange 50 acts as a thumb or finger lever for the workman so the spring member 38 can be actuated in order to release the nub 46 from its mating hole 48. In this same manner, the sleeve member 36 and the entire bracket 34 can be moved vertically along the pole to any desired location.

The mounting bracket 34 also has a pair of sign holding mechanisms 52 and 52' thereon for holding the sign 10 securely in place. The sign holders are made from formed and bent pieces of material in the form shown in FIGS. 4–7. The sign holders 52 and 52' are identical and only one (52) will be described in detail. The corresponding parts of the other holder (52') are labeled with the same reference number followed by a "prime".

The holders 52 and 52' are securely attached to the sleeve member 36 as by welding. The holders 52 and 52' comprise a facing plate 54 (54') which is directly attached to the sleeve 36, a front member 56 (56') and the resilient latch 58 (58'). The three members of each holder, namely the plate 54 (54'), the front member 56 (56') and the resilient latch 58 (58') are connected together at 60 (60') by a pair of pop rivets 62 (62') or similar fastening means. Also, a single facing plate 54 can be utilized for both holders.

Figure 5:
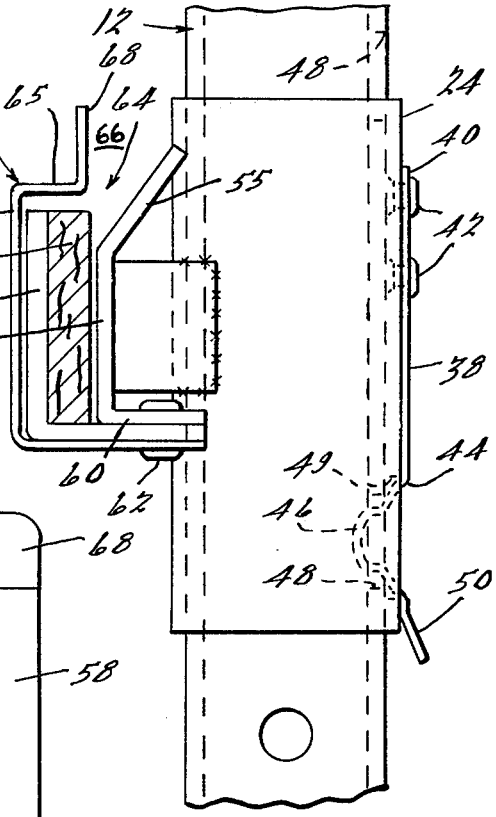
FIG. 5 is a side view of the sign mounting bracket of FIG. 4.
Figure 6:
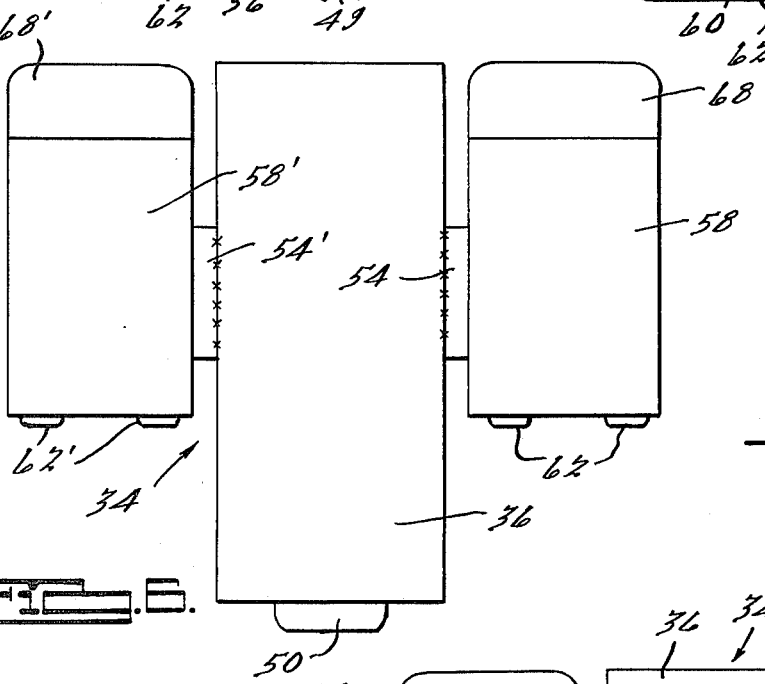
FIG. 6 is a front view of the sign mounting bracket of FIG. 4.
Figure 7:
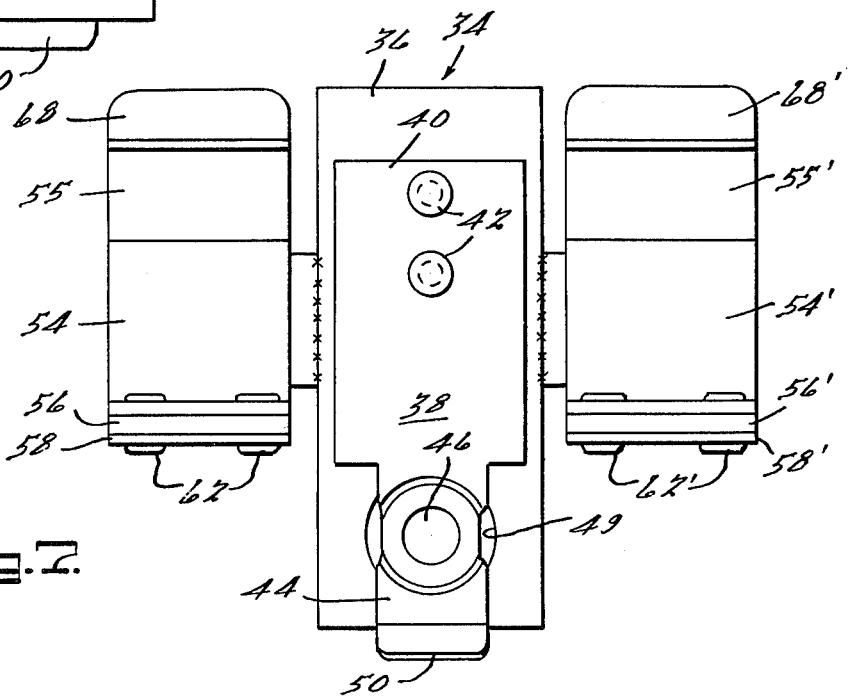
FIG. 7 is a rear view of the sign mounting bracket of FIG. 4.

Each of the sign holders 52 and 52' has a channel 64 (64') which is formed between the front members 56 (56') and the facing plates 54 (54'). The channels are made of a size and shape to hold the horizontal cross-brace 11 of the sign 10 (as shown in FIGS. 2 and 5).

The holders 52 and 52' are separated to provide a clearance space for the vertically disposed cross-brace 13 of the roll-up sign 10. When the sign 10 is mounted on the bracket 34 with the horizontal cross-brace 11 positioned in the holders 52 and 52', the vertical cross-brace 13 will be positioned vertically parallel to the pole 12 and rest closely adjacent to or up against the front surface of the sleeve member 36. (Of course, if the facing plate 54 extends across the front of sleeve member 36, the cross-brace 13 will rest adjacent to it.) The two holders 52 and 52' also act as stop members and contain and prevent the vertical cross-brace 13 from moving sideways (laterally) relative to the bracket 34.

The resilient or spring latch 58 (58') is made from a relatively thin piece of sheet metal. Its upper end 65 (65') is formed to be positioned over the open end 66 (66') of the channels 64 (64'). A flange 68 (68') of the spring latch 58 (58') extends upwardly from the upper end 65 (65') over the channels and is adapted to be activated as a lever by application of manual force. Due to the properties of the spring latch 58 (58') and the way it is bent and fastened to the bracket 34, its upper end 65 is adapted to be flexed out of its position over the channel 64 (64') only by application of a force against the top flange 68 (68'). In this manner, the cross-brace 11 of the sign 10 cannot be removed accidentally from the sign bracket 34 during any usage of the sign stand.

The mounting of the bracket 34 on the pole 12 and the mounting of the sign 10 in the bracket are accomplished as described below. The sleeve member 36 is slid over one portion 24 of the pole 12 and moved to the desired position. As the bracket is moved along the pole, the spring locking member 38 will be canted backwardly since the projection 46 will be resting on the outer plane surface of the pole 12. Once the projection 46 passes over one of the holes 48 in the pole 12, it will snap into the hole locking the bracket in place. If it is desired to move the position of the bracket 34, the spring locking member 38 is pulled backwardly and upwardly by application of a force against the flange 50. As soon as the projection 46 is removed completely from the hole 48, the bracket is free to move along the pole and can be moved to a new location.

Once the bracket 34 is in the desired location, the roll-up sign 10 is installed in the sign holders 52 and 52'. The horizontally disposed cross-brace 11 of the sign 10 is forced downwardly (by manual force) past the flanges 68 and 68' on the spring latches 58 and 58' until it comes to rest in the channels 64 and 64'. The spring latches are sufficiently flexible so that when a force is applied against the top flanges 68 (68') by th cross brace 11, the spring latches will deflect opening the channels 64 (64'). In this regard, the upper part 55 (55') of the facing plate 54 (54') is slanted backwardly away from the top flanges 58 (58') in order to allow the cross-brace 11 to be inserted more easily into the channel 64 (64'). Once the cross-brace is positioned fully in the channels, the spring latches 58 and 58' will return to their normal (rest) positions (as shown in FIGS. 4–7) and act to securely hold the cross-brace 11 and sign 10 in place. As described above, when the spring latches 58 and 58' are returned to their rest positions, the cross-brace 11 cannot be removed accidentally from the channels.

Since the front members 56 and 56' ar disposed between the cross-braces 11 and the spring latches 58 and 58', the forces applied to the sign and cross-braces during normal usage in the field will not directly act on the spring latches 58 and 58'. The forces will instead be taken up by the front members 56 (56') and the facing plate 54 (54') both of which are rigid and made of a strong construction. This will prevent possible premature failure of the flexible spring latches.

Figure 3:
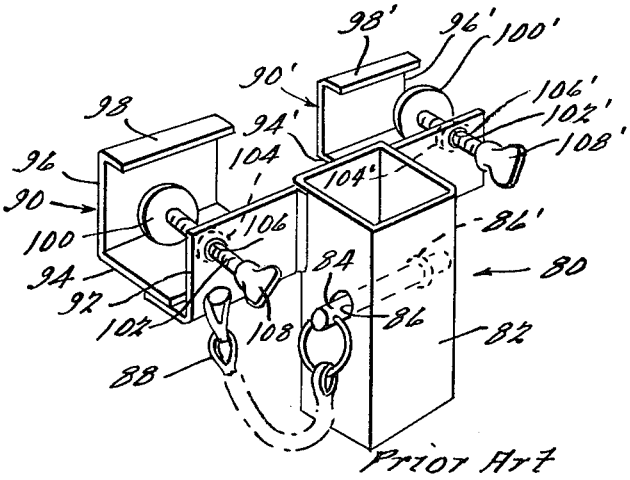
FIG. 3 illustrates a known (prior art) sign mounting bracket.

A prior art sign mounting bracket 80 used currently to hold flexible and roll-up type construction signs in place is shown in FIG. 3. The mounting bracket 80 has a sleeve member 82 which is adapted to be positioned over a portion of the upright sign stand or pole. The bracket 80 is held in place by a pin member 84 which fits through holes 86 and 86' in the sleeve and also through a mating hole (not shown ) in the sign stand. The pin 84 is attached to the bracket 80 by a chain 88 or similar means to prevent the pin from being misplaced or lost.

In order to hold the sign in place, a pair of U-shaped sign mounting members 90 and 90' are attached to one side of the sleeve member 82. The members 90 and 90' are identical and only one needs to be described in detail; the corresponding parts of each member are identified by the same reference number with a "prime" being added to them. The member 90 is formed of a rolled, bent or composite piece of metal or other similar material having a rear portion 92 (92'), a bottom portion 94 (94') and a front portion 96 (96'). A flange 98 (98') is bent at an angle backwardly from the top of the front portion 96 (96'). A pressure plate 100 (100') is attached to a threaded rod 102 (102') which in turn is threaded securely in a threaded bushing 104 (104') press fit in an opening 106 (106') in the rear portion 92 (92') of the member 90 (90'). A handle 108 (108') is secured to the outer end of the rod 102 (102') so it can be turned by hand.

When the sign is mounted in the bracket 80, the horizontal cross-brace of the sign is positioned in the spaces formed between portions 92, 94 and 96 and 92', 94' and 96'. Prior to this, however, the rods 102 and 102' must be retracted in order to pull back the pressure plates 100 and 100' out of the way to a position adjacent the rear portions 92 and 92'. Then, when the cross-brace 11 is dropped into the spaces, the threaded rods 102 and 102' are turned by hand a considerable number of revolutions in order to move the plates 100 and 100' into contact with the cross-brace 11 and press it against the front potions 96 and 96'. In order to remove the sign from the bracket 80 or replace it with another one, the above process is repeated in reverse as will be understood by persons skilled in the art.

As shown by the comparison of the present invention from the known mounting bracket described above, the present invention provides a mounting bracket for signs which provides for much simpler and easier mounting and removal of signs on poles. The signs can be mounted, removed and replaced in less time and with less effort and hassle. The present invention also provides a sign mounting bracket which is easier and quicker to adjust vertically along the pole or sign standard.

The parts of the sign mounting bracket are preferably made of steel or aluminum, but can be made of any material which is strong enought to withstand the forces construction signs are normally exposed to in use.

Although the present invention is described above as being used for flexible or roll-up type signs of diamond shape, it is apparent that the mounting bracket can be used with a wide variety of signs of different materials, rigid or soft, and with signs of widely varying sizes and shapes. With rigid signs, a flange or protruding member similar at least in part to the cross-brace 11 shuld be provided which is adapted to fit within the channels on the bracket 34. It is also conceivable for holders 52 and 52' to be turned 90° and thus for the bracket 34 to be adapted to hold the vertical cross-brace 13 of the sign 10 instead of the horizontal cross-brace 11.

While it is apparent that the preferred embodiment illustrated herein is well calculated to fulfill the objects above stated, it will be appreciated that the present invention is susceptible to modification, variation and change without departing from the scope of the invention, as defined by the following claims.

We claim:

1. A bracket for mounting a sign on a stand, said sign having at least one cross member, said bracket comprising;

a mounting portion for mounting said bracket on said stand, said mounting portion having locking means for locking said bracket onto said stand, and a sign holding member affixed to said mounting member, said sign holding member forming a horizontal rigid channel having an open end, said sign holding member further having a resilient latch which normally encloses said channel open end and which may be moved away from said open end thereby permitting said sign cross member to be removed and replaced within said channel said resilient latch having a first section affixed to said bracket, a second section enclosing said channel open end and a third section forming a projecting flange.

2. The bracket as set forth in claim 1 wherein two of said channels and two of said resilient means are provided.

3. A bracket for mounting a sign having a cross member to a sign stand, said bracket comprising;

a mounting portion for locking said bracket to said stand forming a sleeve slidably overfitting said stand and a resilient locking member having a projection thereon which engages a detent on said stand to support said mounting portion at a preselected position, and a sign holding portion for supporting said stand cross member having two separated rigid channels forming an open end and a resilient latching member forming a moveable surface at said open end of each of said channels, said channels and said resilient latching members having portions defining guide surfaces which cooperate such that when said cross member is moved into said channels, said guide surfaces cause said resilient latching member to be deflected such that said resilient locking members are self latching.

* * * * *